US007497062B2

(12) United States Patent
Metzger

(10) Patent No.: US 7,497,062 B2
(45) Date of Patent: Mar. 3, 2009

(54) ICE BAGGING APPARATUS

(75) Inventor: Mark C. Metzger, Glendale, AZ (US)

(73) Assignee: Reddy Ice Corporation, Dallas, TX (US)

( * ) Notice: Subject to any disclaimer, the term of this patent is extended or adjusted under 35 U.S.C. 154(b) by 0 days.

(21) Appl. No.: 11/931,324

(22) Filed: Oct. 31, 2007

(65) Prior Publication Data

US 2008/0047233 A1 Feb. 28, 2008

Related U.S. Application Data

(63) Continuation of application No. 11/371,300, filed on Mar. 9, 2006, now Pat. No. 7,426,812.

(51) Int. Cl.
*B65B 57/00* (2006.01)

(52) U.S. Cl. ..... 53/58; 53/260; 53/284.4

(58) Field of Classification Search ..... 53/459, 53/469, 570, 58, 260, 284.247, 384.1, 385.1; 62/340, 344
See application file for complete search history.

(56) References Cited

U.S. PATENT DOCUMENTS

| | | | |
|---|---|---|---|
| 2,116,300 | A | 5/1938 | Campos |
| 2,584,726 | A | 2/1952 | McOmber |
| 3,559,424 | A | 2/1971 | Nelson |
| 3,712,019 | A | 1/1973 | Lamka et al. |
| 3,789,570 | A | 2/1974 | Mullins, Jr. |
| 3,807,193 | A | 4/1974 | McKenney et al. |
| 3,897,676 | A | 8/1975 | Membrino |
| 3,913,343 | A | 10/1975 | Rowland et al. |
| 3,918,266 | A | 11/1975 | Gindy et al. |
| 3,969,909 | A | 7/1976 | Barto et al. |
| 3,977,851 | A | 8/1976 | Toya |
| 3,982,377 | A | 9/1976 | Vanderpool |
| 4,013,199 | A | 3/1977 | Brown |
| 4,132,049 | A | 1/1979 | Mullins, Jr. |
| 4,139,029 | A | 2/1979 | Geraci |
| 4,348,872 | A | 9/1982 | Hill |

(Continued)

FOREIGN PATENT DOCUMENTS

| | | |
|---|---|---|
| GB | 1459629 | 12/1976 |

(Continued)

OTHER PUBLICATIONS

U.S. Appl. No. 60/837,374, filed Aug. 11, 2006, Metzger.

(Continued)

*Primary Examiner*—Louis K Huynh
(74) *Attorney, Agent, or Firm*—Haynes and Boone, LLP

(57) ABSTRACT

An ice-bagging apparatus comprises an ice maker for making ice, a hopper for receiving the ice from the ice maker, a drawer system comprising a drawer and a top door operatively associated with the hopper for measuring the ice and delivering of the ice, a bag delivery mechanism including a bag supply mechanism for placing the ice in a bag, a blower engaged to open the mouth of the bag to receive the ice, a sealer for sealing the open mouth of the bag once the bag is filled with the ice, and a control device for managing and monitoring the drawer and bag delivery mechanism and allowing transmission of the collected data to the internet.

10 Claims, 11 Drawing Sheets

U.S. PATENT DOCUMENTS

| | | | |
|---|---|---|---|
| 4,350,004 | A | 9/1982 | Tsujimoto et al. |
| 4,368,608 | A | 1/1983 | Ray |
| 4,404,817 | A | 9/1983 | Cox, III |
| 4,409,763 | A | 10/1983 | Rydeen |
| 4,420,197 | A | 12/1983 | Dreiling |
| 4,461,520 | A | 7/1984 | Alneng |
| 4,612,779 | A | 9/1986 | Hatton |
| 4,689,937 | A | 9/1987 | Finan, Sr. et al. |
| 5,027,610 | A | 7/1991 | Hara |
| 5,088,300 | A | 2/1992 | Wess |
| 5,109,651 | A | 5/1992 | Stuart |
| 5,211,030 | A | 5/1993 | Jameson |
| 5,277,016 | A | 1/1994 | Williams et al. |
| 5,440,863 | A | 8/1995 | Toya et al. |
| 5,458,851 | A | 10/1995 | Schroeder et al. |
| 5,473,865 | A | 12/1995 | Tanaka et al. |
| 5,484,209 | A | 1/1996 | Weng |
| 5,489,769 | A | 2/1996 | Kubo |
| 5,555,743 | A | 9/1996 | Hatanaka |
| 5,577,821 | A | 11/1996 | Chu |
| 5,581,982 | A | 12/1996 | Schroeder et al. |
| 5,630,310 | A | 5/1997 | Chadwell |
| D379,880 | S | 6/1997 | Stoeckli et al. |
| 5,722,750 | A | 3/1998 | Chu |
| 5,761,888 | A | 6/1998 | Haley |
| 5,813,196 | A | 9/1998 | Page et al. |
| 5,822,955 | A | 10/1998 | Woosley et al. |
| D407,092 | S | 3/1999 | Weaver |
| 5,887,758 | A | 3/1999 | Hawkes et al. |
| 6,044,658 | A | 4/2000 | Ryu |
| 6,067,658 | A | 5/2000 | Cho |
| 6,067,806 | A | 5/2000 | Park |
| 6,082,350 | A | 7/2000 | Crews et al. |
| 6,112,539 | A | 9/2000 | Colberg |
| 6,112,558 | A | 9/2000 | Wang |
| 6,119,441 | A | 9/2000 | Lipes et al. |
| 6,134,907 | A | 10/2000 | Mueller et al. |
| 6,238,031 | B1 | 5/2001 | Weng |
| 6,266,945 | B1 | 7/2001 | Schroeder |
| 6,338,002 | B1 | 1/2002 | Kuo |
| 6,354,338 | B1 | 3/2002 | Takemoto |
| 6,377,863 | B1 | 4/2002 | Koontz et al. |
| 6,405,553 | B1 | 6/2002 | Willett |
| 6,427,456 | B2 | 8/2002 | Niwa et al. |
| 6,474,048 | B1 | 11/2002 | Metzger et al. |
| 6,474,049 | B1 | 11/2002 | Lipes et al. |
| 6,502,416 | B2 | 1/2003 | Kawasumi et al. |
| 6,506,428 | B1 | 1/2003 | Berge et al. |
| 6,606,602 | B1 | 8/2003 | Kolls |
| 6,705,107 | B2 | 3/2004 | Schlosser et al. |
| 6,827,529 | B1 | 12/2004 | Berge et al. |
| 6,850,996 | B2 | 2/2005 | Wagner |
| 6,860,111 | B2 | 3/2005 | Sanuki et al. |
| 6,904,946 | B2 | 6/2005 | James |
| 6,932,124 | B2 | 8/2005 | Dalton et al. |
| 6,938,428 | B2 | 9/2005 | Onishi et al. |
| 6,953,132 | B2 | 10/2005 | McCann et al. |
| 7,003,974 | B1 | 2/2006 | Brooks |
| 7,013,657 | B2 | 3/2006 | Hwang et al. |
| 7,062,892 | B2 | 6/2006 | Metzger |
| 7,096,686 | B2 | 8/2006 | Brunner et al. |
| 7,104,291 | B2 | 9/2006 | Dalton et al. |
| 7,207,156 | B2 | 4/2007 | Metzger |
| 7,426,812 | B2 | 9/2008 | Metzger |
| 2004/0084106 | A1 | 5/2004 | James |
| 2004/0216481 | A1 | 11/2004 | James et al. |
| 2006/0005553 | A1 | 1/2006 | Metzger |
| 2006/0005564 | A1 | 1/2006 | Metzger |
| 2007/0175235 | A1 | 8/2007 | Metzger |
| 2007/0209330 | A1 | 9/2007 | Metzger |
| 2008/0110129 | A1 | 5/2008 | LeBlanc et al. |

FOREIGN PATENT DOCUMENTS

| | | |
|---|---|---|
| JP | 2006-105559 | 4/2006 |
| WO | WO 2004042294 | 5/2004 |

OTHER PUBLICATIONS

U.S. Appl. No. 60/941,191, filed May 31, 2007, Metzger.

U.S. Appl. No. 11/837,320, filed Aug. 10, 2007, Metzger.

Office Action issued on Mar. 26, 2007 by Louis K. Huynh, Examiner, U.S. Patent Office, in U.S. Appl. No. 11/371,300.

Information Disclosure Statement filed Mar. 13, 2007 by Applicant, Mark Metzger, in U.S. Appl. No. 11/371,300.

Office Action issued on Feb. 12, 2007 by Louis K. Huynh, Examiner, U.S. Patent Office, in U.S. Appl. No. 11/371,300.

Final Office Action issued on Jul. 18, 2007 by J. Casimer Jacyna, Examiner, U.S. Patent Office, in U.S. Appl. No. 10/701,984.

Decision on Petition issued Apr. 20, 2007 by Derek L. Woods, Attorney, Office of Petitions, U.S. Patent Office, in U.S. Appl. No. 10/701,984.

Decision on Petition issued Nov. 8, 2006 by by Derek L. Woods, Attorney, Office of Petitions, U.S. Patent Office, in U.S. Appl. No. 10/701,984.

Notice of Abandonment issued Mar. 7, 2005 by J. Casimer Jacyna, Primary Examiner, U.S. Patent Office, in U.S. Appl. No. 10/701,984.

Office Action issued Jul. 12, 2004 by J. Casimer Jacyna, Primary Examiner, U.S. Patent Office, in U.S. Appl. No. 10/701,984.

Louis K. Huynh, Notice of Allowance and Fee(s) Due regarding U.S. Appl. No. 11/371,300, Aug. 4, 2008; 6 pages; U.S. Patent and Trademark Office.

Louis K. Huynh, Notice of Allowance and Fee(s) Due regarding U.S. Appl. No. 11/371,300, Apr. 21, 2008; 9 pages; U.S. Patent and Trademark Office.

Louis K. Huynh, Office Action/Restriction Requirement regarding U.S. Appl. No. 11/371,300, Feb. 12, 2007; 5 pages; U.S. Patent and Trademark Office.

ICE BAGGING APPARATUS

This application is a continuation of U.S. application No. 11/371,300, filed on Mar. 9, 2006.

FIELD OF THE INVENTION

The present invention relates to an ice bagging apparatus. More specifically, but not by way of limitation, the present invention relates to an ice bagging apparatus, method of using the apparatus, and the process of remotely monitoring the apparatus from a remote location.

BACKGROUND OF THE INVENTION

The production of ice for consumer consumption is a major industry. Consumers require ice for drinks, ice chests, refrigeration, etc. Typical ice production requires the use of an ice maker that disposes ice into a storage bin. The ice is then bagged by hand. The bags of ice are then stacked into a freezer. The bags can then be retrieved from the freezer by users.

In the retail business, many times the bags of ice are delivered to the store site. A freezer, located at the retail business, will store the bags of ice. Hence, these prior art devices require that the ice maker and the dispenser (freezer) be separate. The separation of the ice maker and freezer leads to many problems, including but not limited to transportation, inadequate inventory, time delivery problems, wet slippery floors, etc.

Some prior art devices have attempted to locate the ice maker and the dispenser in one unit and locate the dispenser at the retail site. However, these prior art devices have had many problems. For instance, if the device is in a retail establishment and the device develops a problem, the employees of the retail establishment have no expertise in repairing the device. Additionally, these prior art devices have been unreliable in their attempt to automate the process due to the numerous cooperating components. For example, during the bagging process, the ice can bridge thereby effectively halting the placement of the ice into the bags. Therefore, there is a need for a device that can break up the ice so it can be packaged without clumps. There is also a need for an apparatus that can operate autonomously. Additionally, there is a need for a device that will collect information regarding the production of ice, and reliably store and report that information to a remote location. These needs, as well as many others, will be met by the herein described invention.

SUMMARY OF INVENTION

Briefly described, the present invention overcomes the above mentioned disadvantages and meets the recognized need for such a device by providing an ice-bagging apparatus and method that provides an establishment with the ability to automatically and expeditiously produce, bag, and store bags of ice, thus maintaining a desire supply of bagged ice by eliminating conventional methods of manual ice bagging and reducing the likelihood of unwanted bridging of the ice particles/cubes.

In accordance with the principles of the present invention, an ice-bagging apparatus is provided having an ice maker and hopper for receiving ice from the ice maker. The ice-bagging apparatus of the present invention can preferably include a drawer measuring and delivery system, a bagging mechanism for bagging the ice, a freezer for storing the bagged ice, and a control panel for managing and monitoring the system.

More specifically, an ice bagging apparatus in accordance with the principles of the present invention can include an ice maker, a hopper for receiving ice from the ice maker, a drawer system that measures the amount of ice to be bagged and delivers the ice to an opened bag. The bag can be fed through the apparatus via a bag supply mechanism.

The drawer system can include a top door and a drawer. When the system is waiting for the ice from the ice from the ice maker, the top door is in the open position and the drawer is in the fill position. Once the drawer is filled with the desired amount of ice the top door closes, and the drawer moves up the ramp to the dump position this process is controlled by a computer program that monitors the amount of ice in the compartment and controls the top door and drawer allowing the ice to fill the opened ice bag. A blower fan can be engaged to open the mouth of the bag to receive the ice. The ice can then be dumped into the waiting bag. The filled bag can then be sealed using for example a heat seal bar. The sealed bag can be then rotated out of the seal operation and dropped into a freezer/storage unit. The entire process can be fully automated and/or computer controlled.

In one aspect of an ice bagging apparatus in accordance with the principles of the present invention, sensor switches can be positioned at specific areas on the machine for reading the process at various stages to properly time the sequence of operation. Additional sensors can be used to read a signal code on the bag roll ensuring only a select type of bag/brand can be used.

In accordance with the principles of the present invention, if the equipment encounters a problem, the electronics with the equipment can attempt to correct the problem. If the electronics provided cannot correct the problem, a signal can be sent via a telecommunications means to a secured web site for assistance in repairing the malfunction. This web site can also gather information, such as for example the number of bags produced, number of unused bags in the system, sales history, merchandiser temperature, and error codes for diagnostics, etc.

In one embodiment in accordance with the principles of the present invention, a process of bagging ice with an ice bagging apparatus is provided. The process comprises making ice and channeling the ice to a hopper, then to a drawer system. Next, the amount of ice is measured in the drawer and a bag is supplied via a bag supply mechanism. The drawer system utilizes a top door and a drawer to measure the desired amount of ice. An ice storage bag can be positioned via a roller assembly and a blower fan can open the bag. The top door of the drawer system is closed, after filling the drawer with ice, then the drawer of ice is moved up the ramp allowing the ice to fall into the waiting opened ice bag. The number of cycles can be controlled by a control to deliver the proper amount of ice. After the desired amount of ice has been deposited within the opened bag, the bag is sealed with for example a heat seal bar and separated. The sealed bag can be rotated into a freezer/storage unit.

In accordance with the principles of the present invention, the process may further include placing a plurality of sensor switches at specific areas on the apparatus for reading the process at various stages to properly time the sequence of operation. In another embodiment, a sensor can be placed to read a signal code on the bag reel. A control operatively associated with the ice bagging apparatus can read the sensors and store the information obtained from the sensor switches within control memory. Next, the information can be transmitted to a secured web page accessible on the Internet and authorized remote users may monitor the information found on the web page for monitoring production of ice bags, for reporting, and for regular maintenance.

An ice bagging apparatus in accordance with the principles of the present invention can continuously and automatically produce bags of ice, thus maintaining a desired supply of bagged ice. An ice bagging apparatus in accordance with the present invention has the ability to send and receive communication signals for regular maintenance and reporting. An ice bagging apparatus in accordance with the present invention drains water as it is produced from ice maker to eliminate the potential problem of water in the bags of ice. An ice bagging apparatus in accordance with the present invention functions without the use of augers as utilized in prior art machines. An ice bagging apparatus in accordance with the present invention eliminates the possibility of bridged ice and increases the production rates by use of an agitation mechanism.

An ice bagging apparatus in accordance with the principles of the present invention will reduce a vendor's overall cost of bagged ice. One embodiment of an ice bagging apparatus in accordance with the present invention includes electronic ability to attempt to correct problems associated with its components and/or machine parts. If the problems cannot be corrected internally, a signal can be sent for further assistance in remedying the problem through its global networking system.

An ice bagging apparatus in accordance with the principles of the present invention will utilize less space than prior art machines giving customers more costly floor space in their stores for displaying other merchandise.

These and other objects, features, and advantages of the present invention will become more apparent from the above description and claims when read in light of the accompanying drawings.

DETAILED DESCRIPTION OF THE PREFERRED EMBODIMENTS

Figure 1:
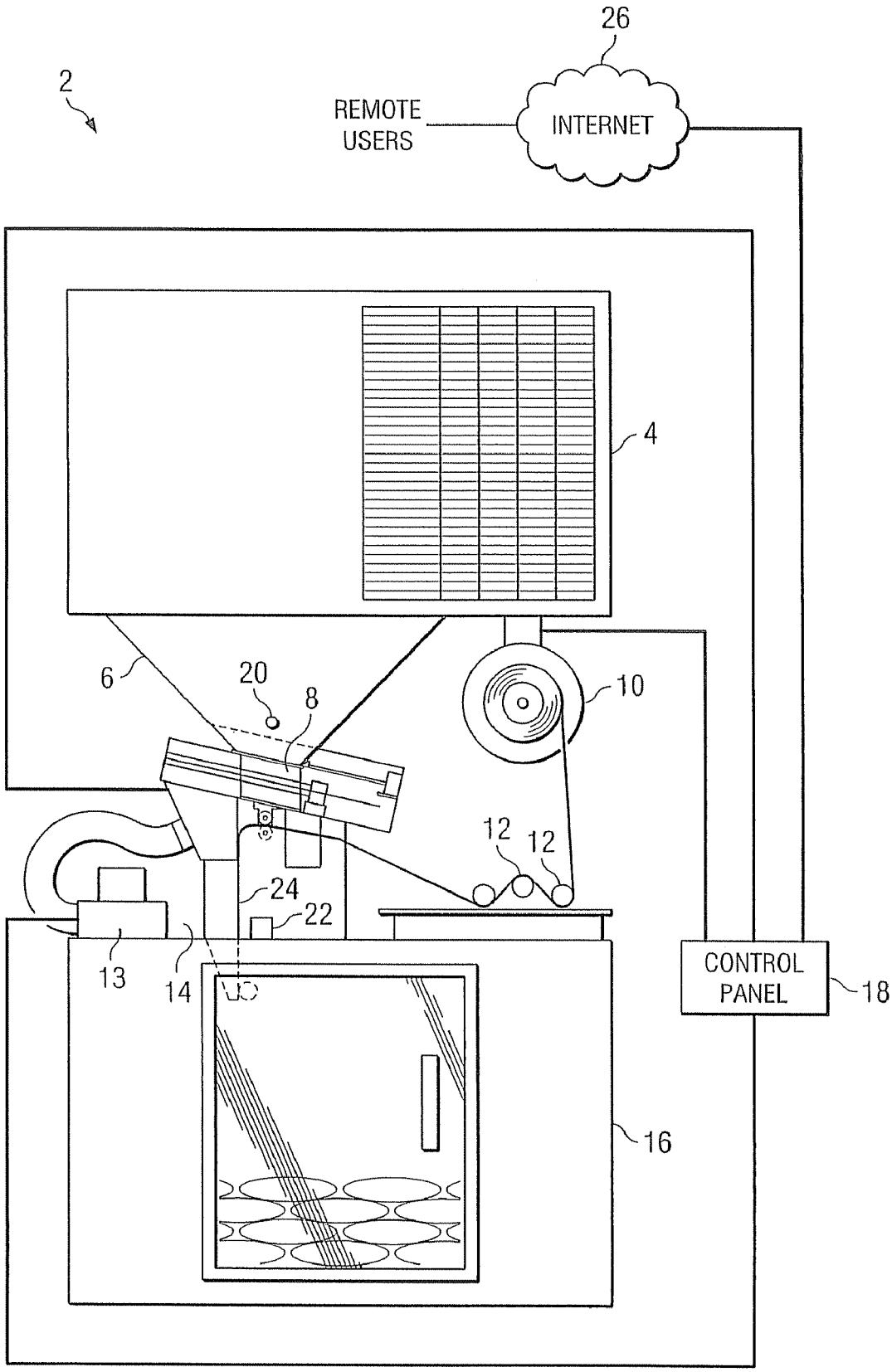
FIG. 1 is a schematic illustration of an ice bagging apparatus in accordance with the principles of the present invention.
Figure 2:
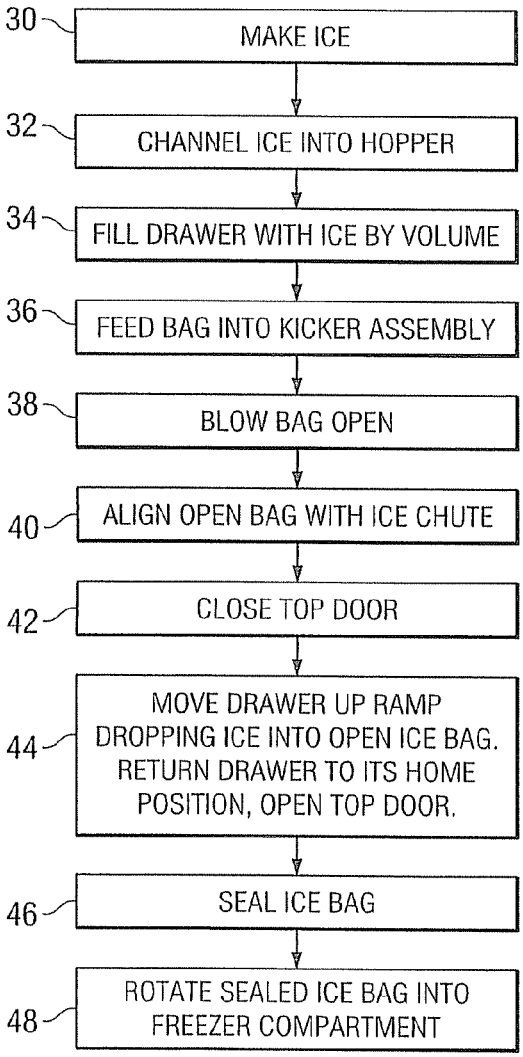
FIG. 2 is a flow chart of the ice bagging process in accordance with the principles of the present invention.

Referring to FIGS. 1 and 2, a schematic illustration of one embodiment of an ice bagging apparatus in accordance with the principles of the present invention will be described. The apparatus of FIG. 1 includes an ice maker for making ice. The ice maker can be operatively associated with a hopper for receiving the ice from the ice maker. A drawer, operatively associated with the hopper, can be included which measures ice and delivers the ice.

The apparatus of FIG. 1 can also include a bagging mechanism, adapted to receive the ice from the drawer system for placing the ice in a bag. The bagging mechanism can include a bag supply mechanism. The bag supply mechanism can comprise a cylinder containing rolled up plastic bags, a roller bar system, used for advancing the bags from the cylinder, a blower fan engaged to open the mouth of the bag to receive the ice, and sealer for sealing the open mouth of the bag once the bag is filled with ice. In one embodiment, the sealer is a heat sealer for heat sealing the bags. The apparatus of FIG. 1 can further include a freezer for storing the bagged ice, so that after the ice is dumped into the opened ice bag, and then sealed, the bag is then separated and placed into the freezer.

FIG. 1 further depicts control for managing and monitoring the drawer, doors, and bagging. In one embodiment, the control can include sensor switches, seen generally for reading the process at various stages to properly time the sequence of operation of the ice bagging. The information collected via the sensor switches can be sent to the control for storage and processing. Also, the bag roll can include a signal device containing identifying information. The control can further read the signal code from the roll, ensuring only a select type of bag can be used.

In one embodiment, the control can further store the information obtained from the sensor switches and sensor in storage. The storage is operatively associated with the control. The information can be transmitted to a secured web page accessible on the Internet. Hence, remote users can then log onto the Internet, and monitor the entire ice making, bagging, and distribution. The remote users can also attempt to trouble shoot problems based on the diagnostic data that has been collected via the control.

Referring now to FIG. 2, a flow chart of the ice bagging process in accordance with the principles of the present invention will be described. First, ice is made with the ice maker (step 30), and then the ice is channeled to the hopper (step 32). The amount of the ice can be measured in the drawer (step 34). A bag is then supplied via a bag supply mechanism (step 36). Once the drawer is filled with desired amount of ice, the top drawer closes (step 38). Next, an open mouth of the bag is engaged with a blower fan (step 40), and the bag can be blown open with the blower fan (step 42). The drawer moves up the ramp and the ice is dumped into the waiting bag (step 44). The bag can be sealed with for example a heat seal bar and separated (step 46). Next, the sealed bag is rotated into a freezer/storage unit (step 48).

Figure 3:
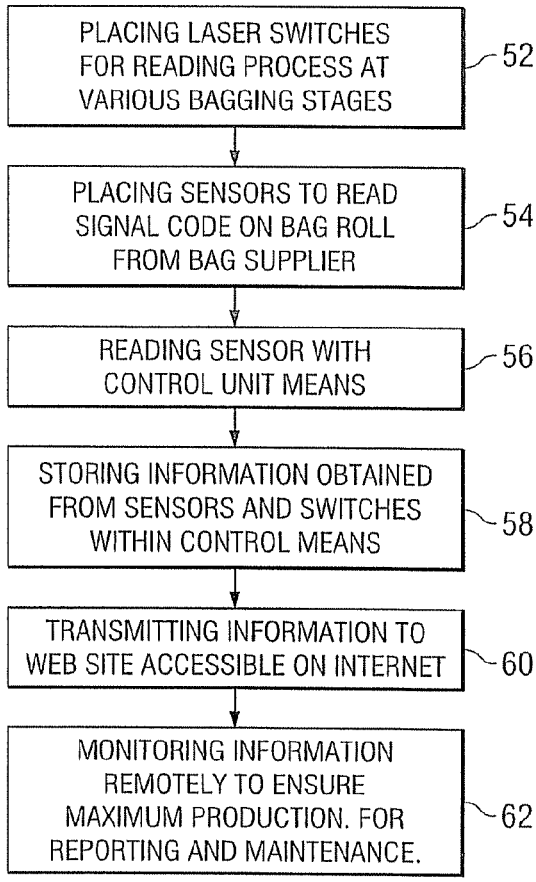
FIG. 3 is a flow chart of the control unit operation and process in accordance with the principles of the present invention.

FIG. 3 is a flow chart of the control unit operation and process in accordance with the principles of the present invention. The process can include placing laser switches at specific areas for reading the process at various stages to properly time the sequence of operation (step 52). Sensors can be placed to read a signal code on the bag roll from the bag supply mechanism, (step 54). The process can further include reading the sensor with the control unit, located on the apparatus, (step 56), and storing the information obtained from the sensor switches and sensors within the control (step 58).

Next, the process can include transmitting the information to a secured web page accessible on the Internet (step 60). A remote user can monitor the information found on the web page to ensure production of ice bags for reporting, and regular maintenance (step 62).

Figure 4:
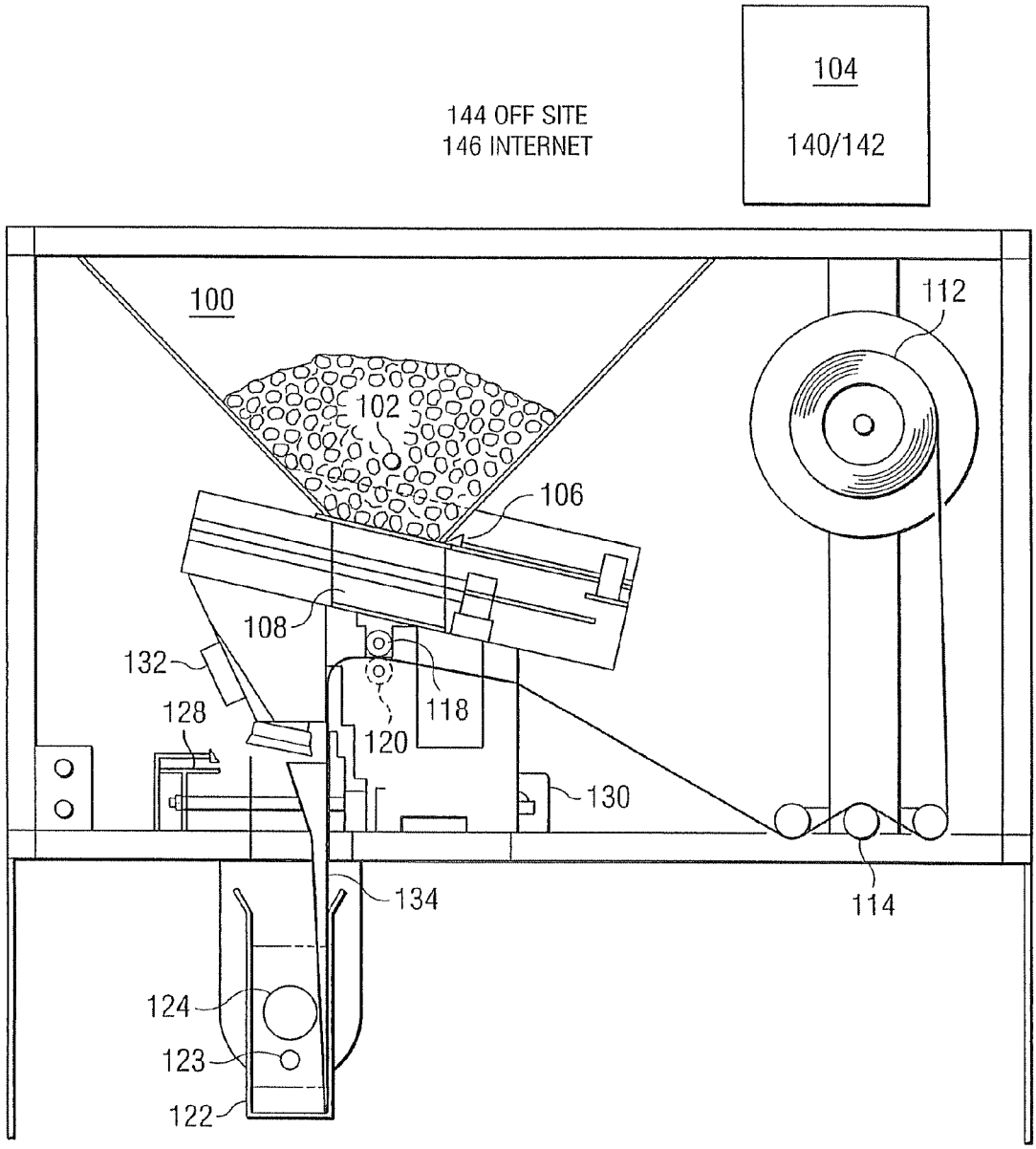
FIG. 4 is a schematic illustration of another embodiment of an ice bagging apparatus and system in accordance with the principles of the present invention.

Referring now to FIG. 4, a schematic illustration of another embodiment of an ice bagging apparatus and system in accordance with the principles of the present invention will now be described. FIG. 4 depicts a hopper, wherein the hopper can be preferably made of food grade stainless steel. The hopper has associated therewith a hopper sensor. This sensor is a photo cell with laser, wherein the cell is at the front part of the hopper facing the service technician with the reflector on the back side of the hopper. The sensor senses, via the laser beam, when the hopper has sufficient ice to fill an open bag. The sensor signals the control. If ice is present, the sensor sends a signal to the control, sometimes referred to as a control panel, that ice is present and is ready for bagging. The sensor is mounted on the hopper and is in electrical communication with the control panel.

The system can further contain a drawer system for collecting and dispensing the ice. The drawer system includes a top door and a drawer. In the home position the drawer is waiting for ice to enter the hopper. A photo optic sensor can monitor the amount of ice in the hopper. When enough ice is in the hopper to produce one more bag, the top door will close and the drawer moves up the ramp. The ice then drops into the waiting ice bag. The drawer will then return to its home position. The top door opens and is now ready for another cycle. The control system can monitor the number of cycles the compartment system needs to fill different size ice bags. For example a seven pound bag of ice needs to dump twice; a ten pound bag of ice is required to dump three times.

The embodiment of FIG. 4 also depicts one embodiment of a bag delivery system. The ice bags are placed on the roll. When the bags are on the roll, the bags consist of a continuous extruded tubular enclosure. The bags are pre-perforated to specific measurement. The bag rolls also contain digitally coded information that can be read by a sensor, which can relay the information to the control panel for processing and storage. The digitally coded information may be in the form of an electronic code. The information on the bag may include the bag number, bag type, bag name, etc.

The bags are filled with ice prior to sealing, and the proper amount of ice cubes will be placed into the waiting bag. From the roll, the bags are led to the idle roller. The idle rollers stretch out the bags and hold resistance on the bags while the bags are fed into the ready position. In turn, the bag guide guides the bag into the feed roller. The feed roller is operatively associated with the roller that can be operatively connected to a stepper type of motor.

The roller is mounted top and bottom, and pulls the bags into the staging area of the bagger. A bag bottom sensor reads the rectangular bar on the right side of the bag and stops the bag at the right location each time. Software can control the system to feed the bag a predetermined length.

The feed motor for roller can be a digital motor that is controlled via preprogrammed instructions. The feed motor for roller can be operatively connected to the control panel so that the instructions can be signaled to the feed motor, and information can in turn be sent back to the control panel for processing and storage and transmission. The rotation of the motor for roller is controlled by the software. The bag basket can preferably be constructed of stainless steel. The position of the bag is detected by the sensor, and that positional information signal is relayed to the control. In effect, the system instructs the bags when to move and stop. The position of the bag is controlled by the bag bottom sensor.

Once the bag has filled with ice, the bag can be sealed and separated. A heat seal and the bag cutter can be seen generally in FIG. 2 and FIG. 9. The heat seal bar can be moved with a lineal actuator motor which provides for lateral movement of the heat sealer and cutter. The motor can be located under the slide area and can be driven by gears and limit switches to control the pulses the unit goes through while sealing the bag. Micro switches (not shown) can provide further control. The heat seal strip can be controlled with a thermostat and in one embodiment, can be approximately three times to get the best bag seal. The bag is separated with the cutters and bag advance motor. The bag is then rotated out of the basket.

The bag basket rotates in order to dump a filled bag of ice after the bag has been separated from the bag roll. The sensor controls the positions of the holding the basket. The sensor causes the basket return to its home position. The sensor can be mounted within the bag basket. The motor sensor is controlled with software that determines the timing for rotation. Sensor makes the holding basket return to the home position after the dumping process occurs.

As seen in FIG. 4, the specific bag is contained within a bag basket. The bag basket holds the bag while being filled. A rotator motor can be attached to the basket, which rotates the filled bag of ice out into the freezer after it has been filled, sealed, and separated. The bag basket is operatively associated with the basket rotator motor. This motor is controlled by the basket rotator sensor mounted on the motor brackets which starts and rotates the motor to its home position after dumping occurs.

Hence, FIG. 4 depicts an individual bag that has advanced to a position within the basket. The blower fan will activate so that the top of the bag will open. The blower fan is connected to chute. The individual bag, which was unfurled from the roll, is seen advanced into the basket. Ice is seen in the hopper as well as within the drawer.

As noted earlier, the various sensors are continually gathering information. This information is being sent to and stored within the control, and in particular within a computer. The computer will store and process the information. Pursuant to a predetermined transmission schedule, the communication module will periodically transmit certain gathered information to a central server. The transmission link may be wireless, hardwired or a satellite frequency signal. From this central server, remote users can access the information for monitoring. In one embodiment as seen in FIG. 4, the central server may in turn be connected to the Internet. Additionally, certain remote users will have the ability to communicate with the ice bagging apparatus by transmitting a signal that will be received by the communication module, and in turn download the files to the computer. Thus, it is possible to download software, which could include instructions to make the apparatus perform a special operation such as for example updating files or operations.

Figure 5:
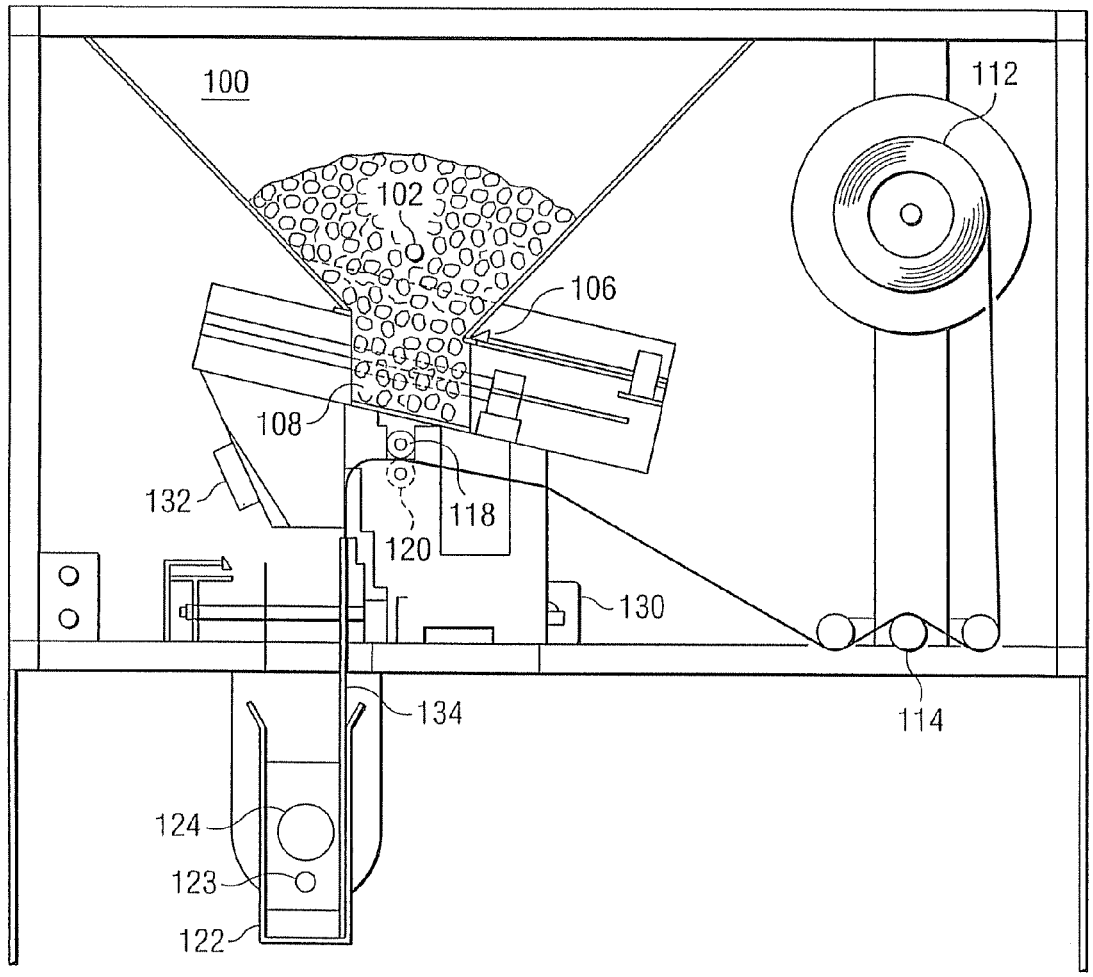
FIG. 5 is the schematic illustration of the embodiment of FIG. 4 showing a sequence of the ice bag being blown open.

FIGS. 5 through 9 show a sequence of operation of the apparatus. FIG. 5 depicts the schematic sequence illustration of the embodiment of FIG. 4 showing that the top of the bag has been blown open via activation of the blower. Once the top is opened, the holding plate can swing open thereby keeping the top of the bag open for the delivery of the ice, as will be more fully explained.

Figure 6:
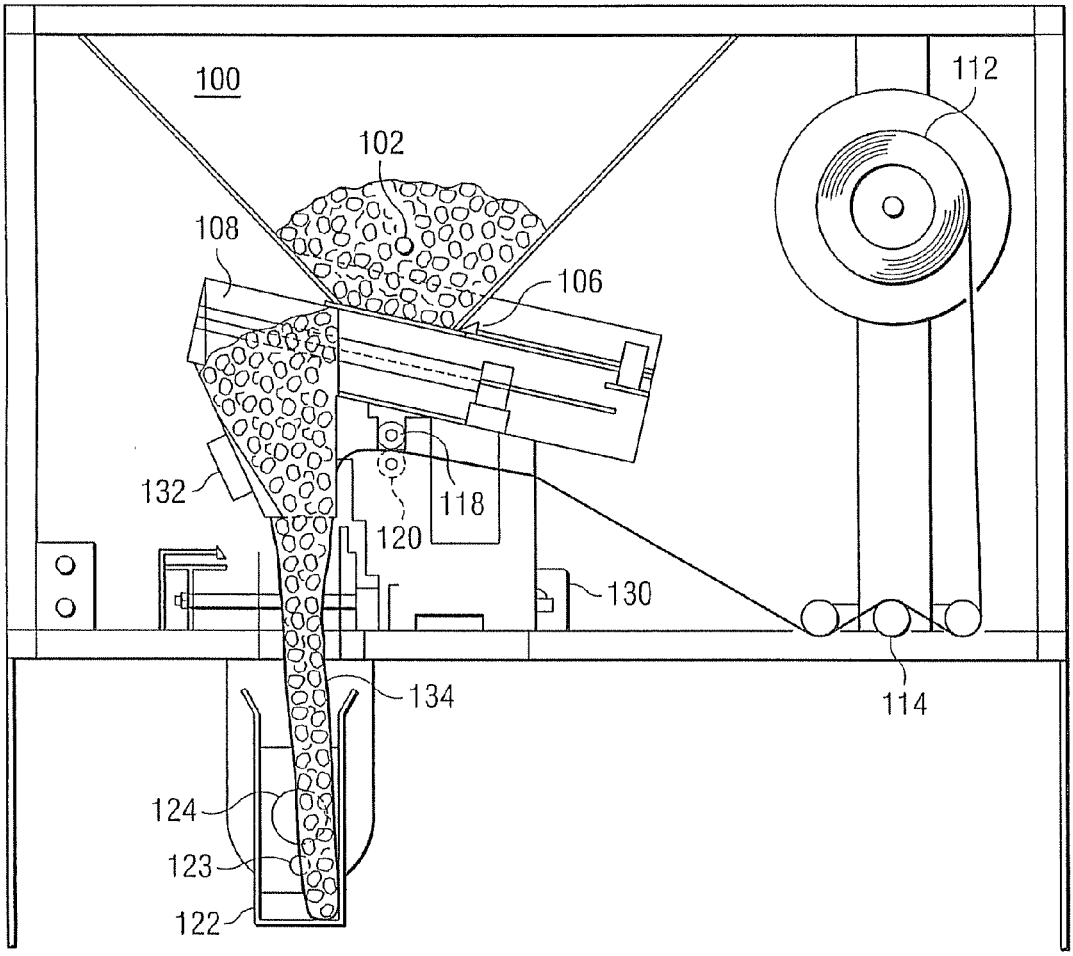
FIG. 6 is the schematic illustration of the embodiment of FIG. 4 showing a sequence of channeling the ice into the ice bag.

FIG. 6 is a schematic illustration of the embodiment of FIG. 5 showing the sequence of channeling ice into the ice bag. The ice is being dumped into the open bag via the drawer system. The drawer moves up the ramp allowing the ice to be channeled into the open ice bag. Note the top door is closed during this process. This ensures that a known and certain volume of ice is placed into the waiting bag. In some cases, multiple cycles (filling and emptying of the drawer) may be required. For instance, a small bag may require a single cycle, a medium bag two cycles and a large bag three cycles. In accordance with the present invention, the apparatus can be used with all of these types of bag; the operator can simply reprogram control to signal the motors as to the proper number of cycles.

Figure 7:
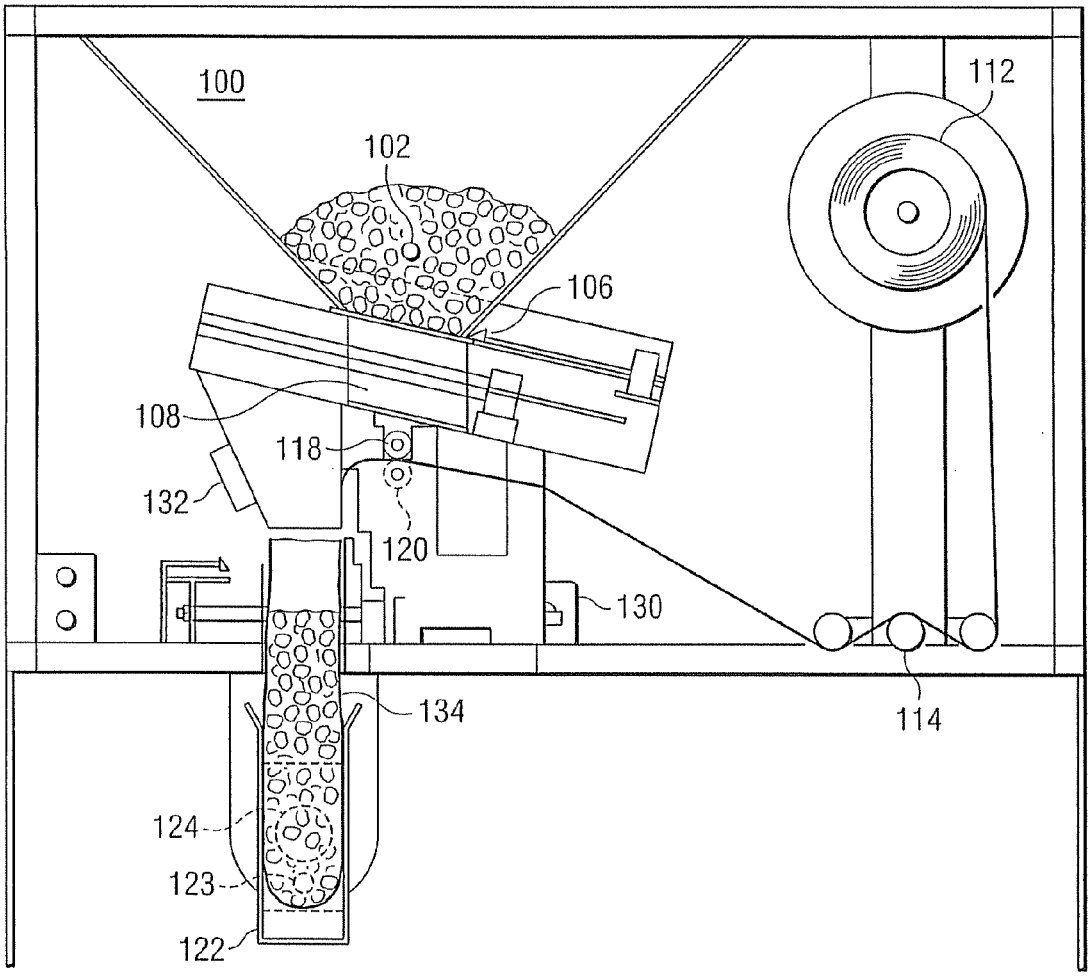
FIG. 7 is the schematic illustration of the embodiment of FIG. 4 showing a sequence of the drawer system allowing the ice to fall into the bag.

FIG. 7 is the schematic illustration of the preferred embodiment of FIG. 4 showing the sequence of the compartment having allowed the ice to fall into the bag. The top door closes blocking any more ice from entering the drawer area, drawer moves up the ramp dropping a predetermined amount of ice into the waiting ice bag. Hence, FIG. 7 depicts the sequence where ice is building up on the top side of the drawer.

Figure 8:
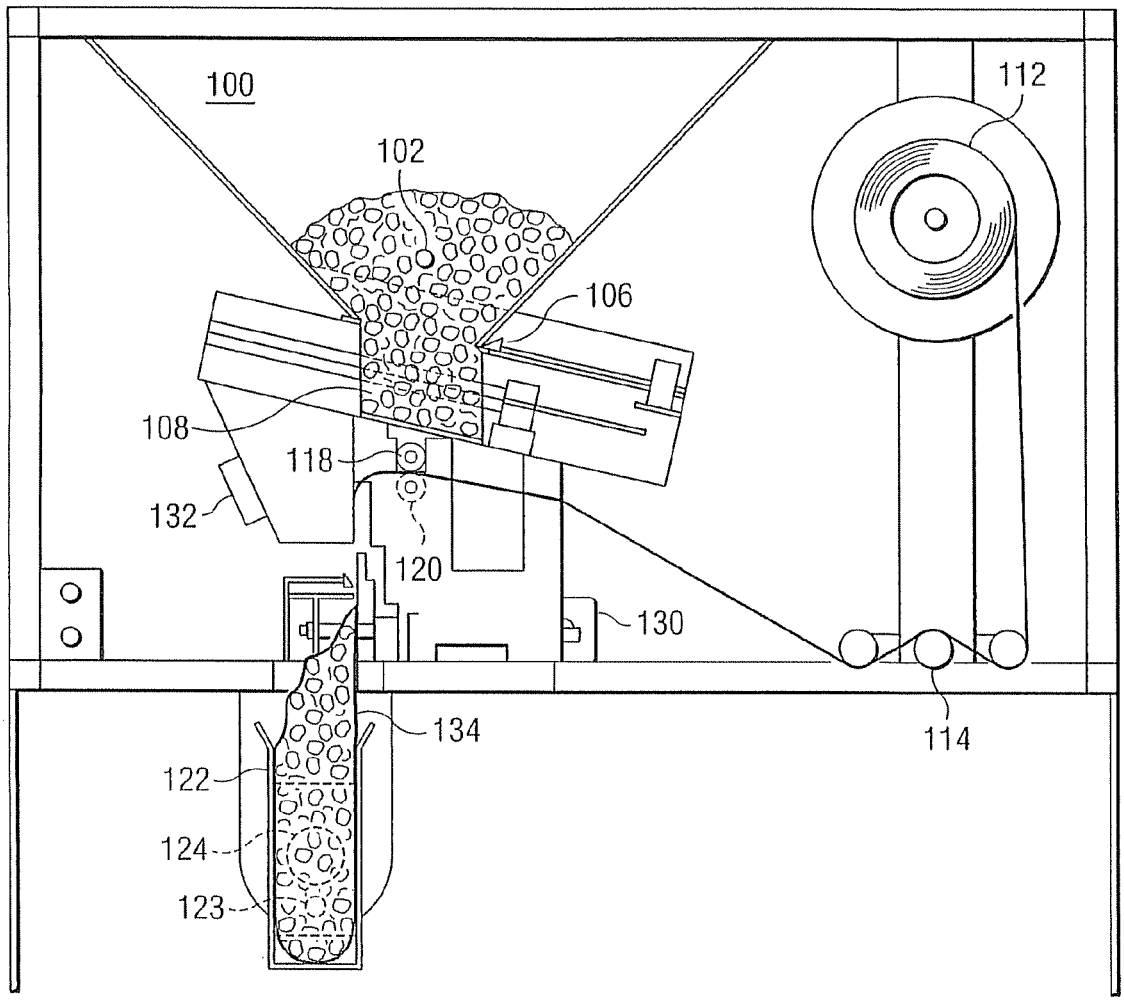
FIG. 8 is a schematic illustration of the embodiment of FIG. 4 showing a sequence of the bag being separated and sealed.

FIG. 8 is a schematic sequence of the embodiment of FIG. 4 showing the bag being separated and sealed. More specifically, the heat seal bar and bag cutter have been moved via a motor laterally into contact with the top of the bag. The motor can be located under the slides with a gear driving the heat seal bar to pulse the correct amount of times to seal the bag. The motor is connected to limit switches to operate the motor sequence. Hence, the bag will be cut and heat sealed thereby providing a closed container. Upon the completion of the sealing sequence, the same limit switches send a signal to the controller to rotate the bag out of the basket.

Figure 9:
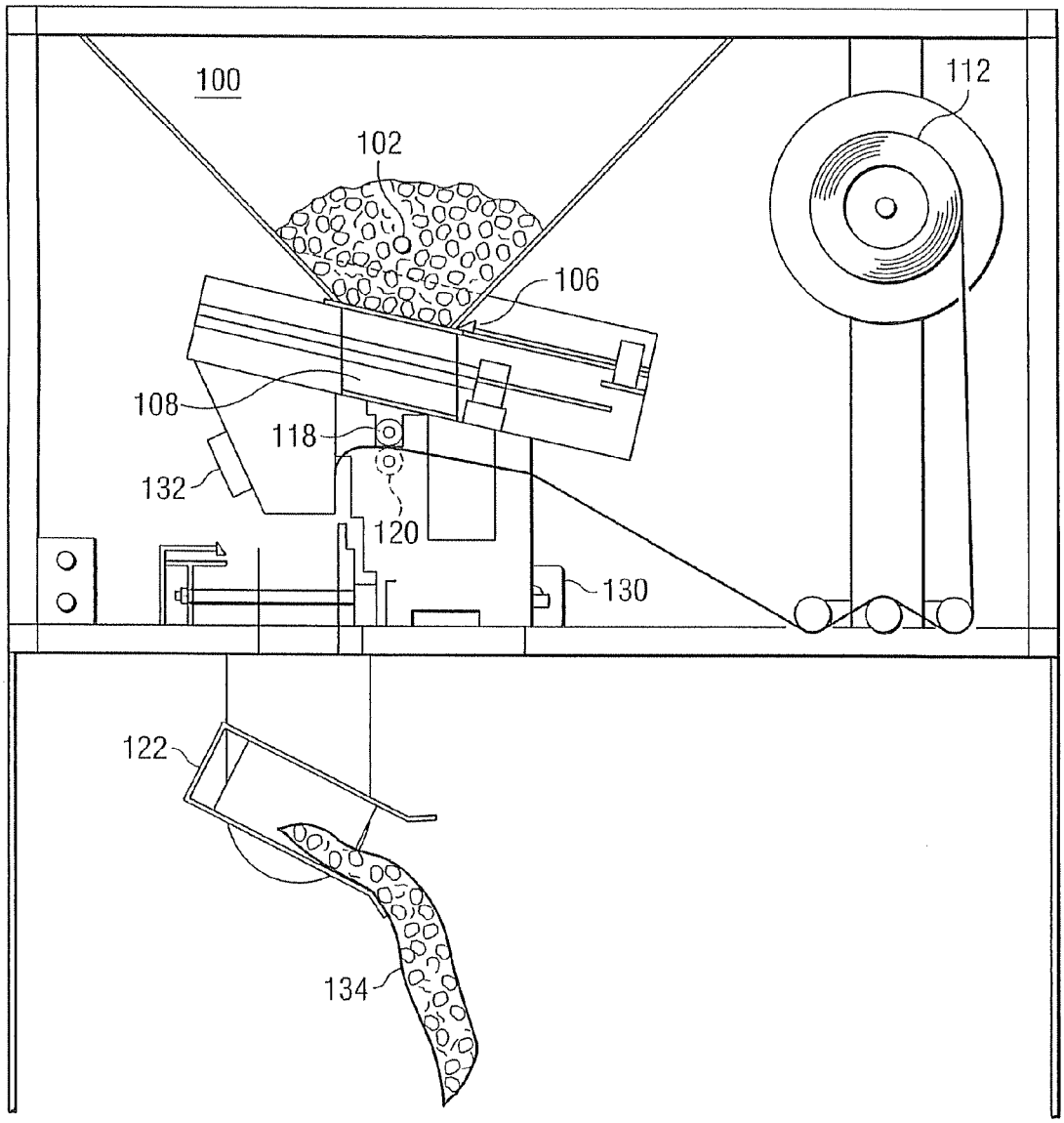
FIG. 9 is a schematic illustration of the embodiment of FIG. 4 showing a bag being rated out of the basket.

FIG. 9 is a schematic illustrating the next sequence of the bag being rotated out of the basket. This is performed via the basket rotor motor, whereby the bag is dropped into the freezer for storage. The motors in the bag basket will rotate the basket back into its upright home position.

Figure 10:
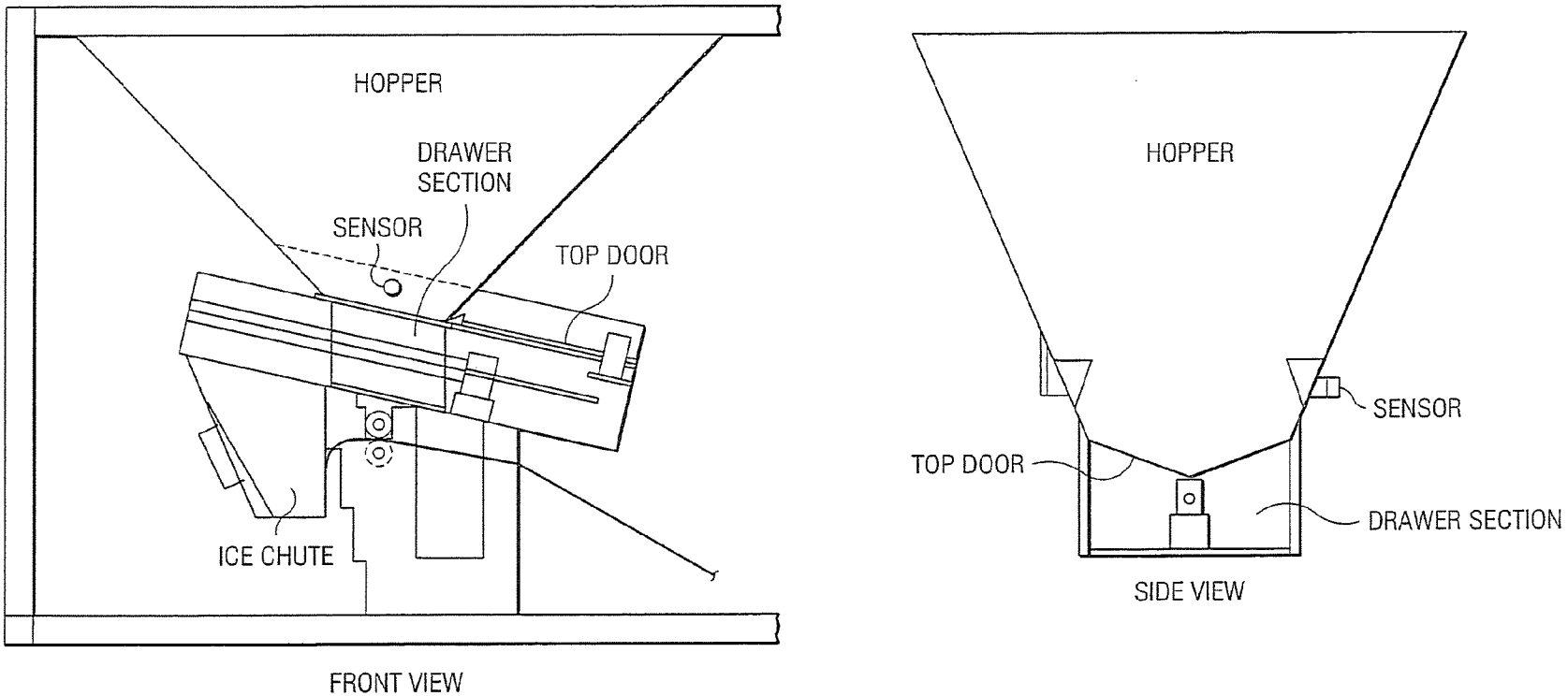
FIG. 10 is a disassembled view of an embodiment of the drawer system.

A disassembled view of one embodiment of the drawer system is illustrated in FIG. 10. The drawer system is located at the bottom of the hopper assembly, utilizing the top door that is in the normally open position, allowing ice to enter the drawer section. The drawer is in the home position waiting for ice. There is a photoelectric sensor just above the top door of the drawer section. When ice enters the hopper area and blocks this photoelectric sensor the top door will close sealing off the drawer section from the rest of the ice in the hopper. The drawer will then move up the ramp dropping a predetermined amount of ice into the waiting ice bag. This process will repeat until the desired amount of ice has been dropped into the ice bag. Both the top door and the drawer are operated utilizing lineal actuators that are controlled by the system software. An operator can control the amount of cycles the drawer sections goes through, allowing for different bag sizes.

Figure 11:
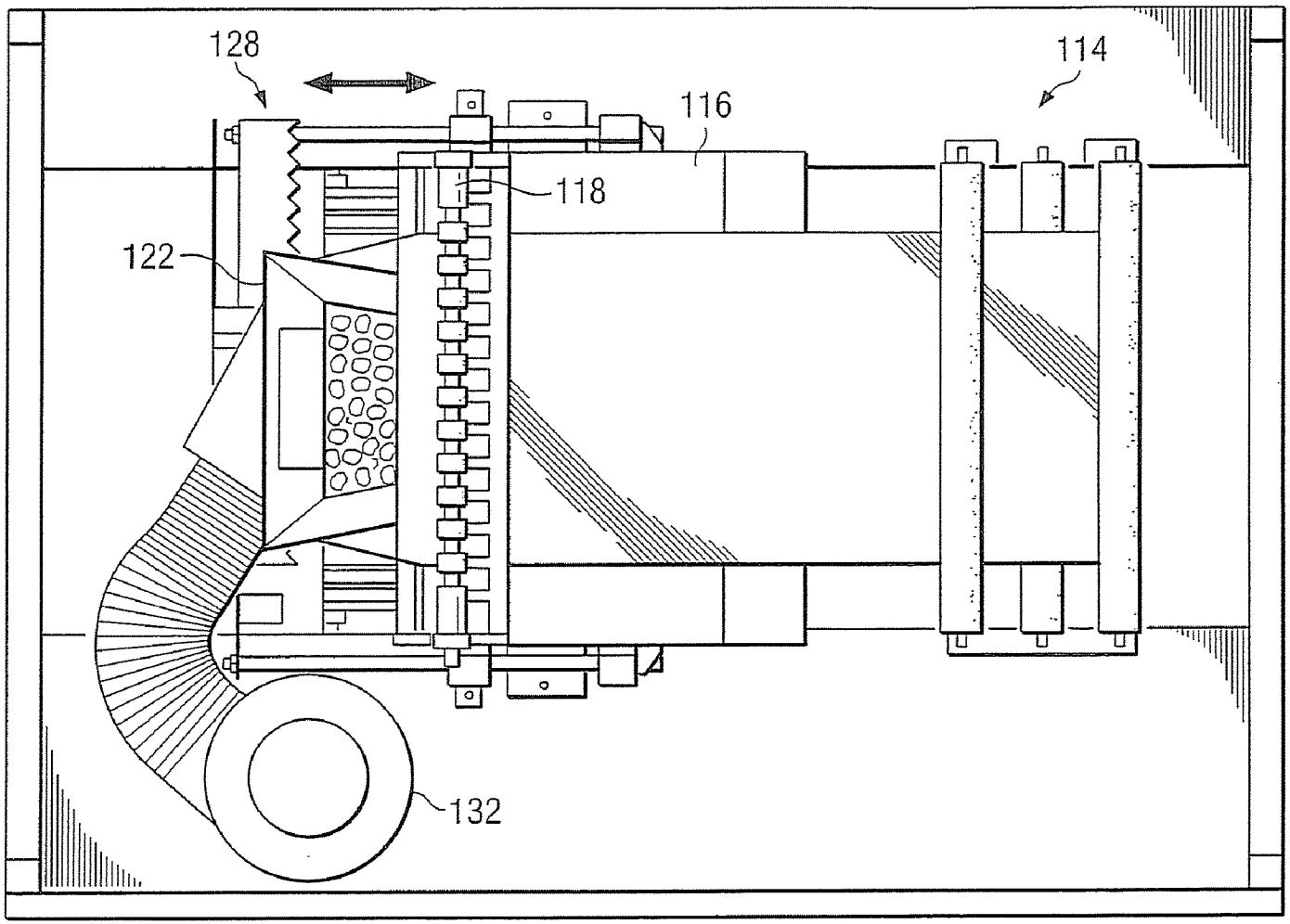
FIG. 11 is a cross-sectional view of the embodiment of FIG. 4 taken along line 11-11.

FIG. 11 is a cross-sectional view of the apparatus taken along line 11-11 of FIG. 4. FIG. 11 depicts the idle rollers as well as the bags from the bag roll positioned on the bag guide. The bags cooperated with the feed roller. FIG. 11 also shows the heat seal bar and bag cutter, as well as the blower fan. As noted earlier, the heat seal bar and bag cutter travels laterally back and forth, as denoted by the arrow "A".

Figure 12:
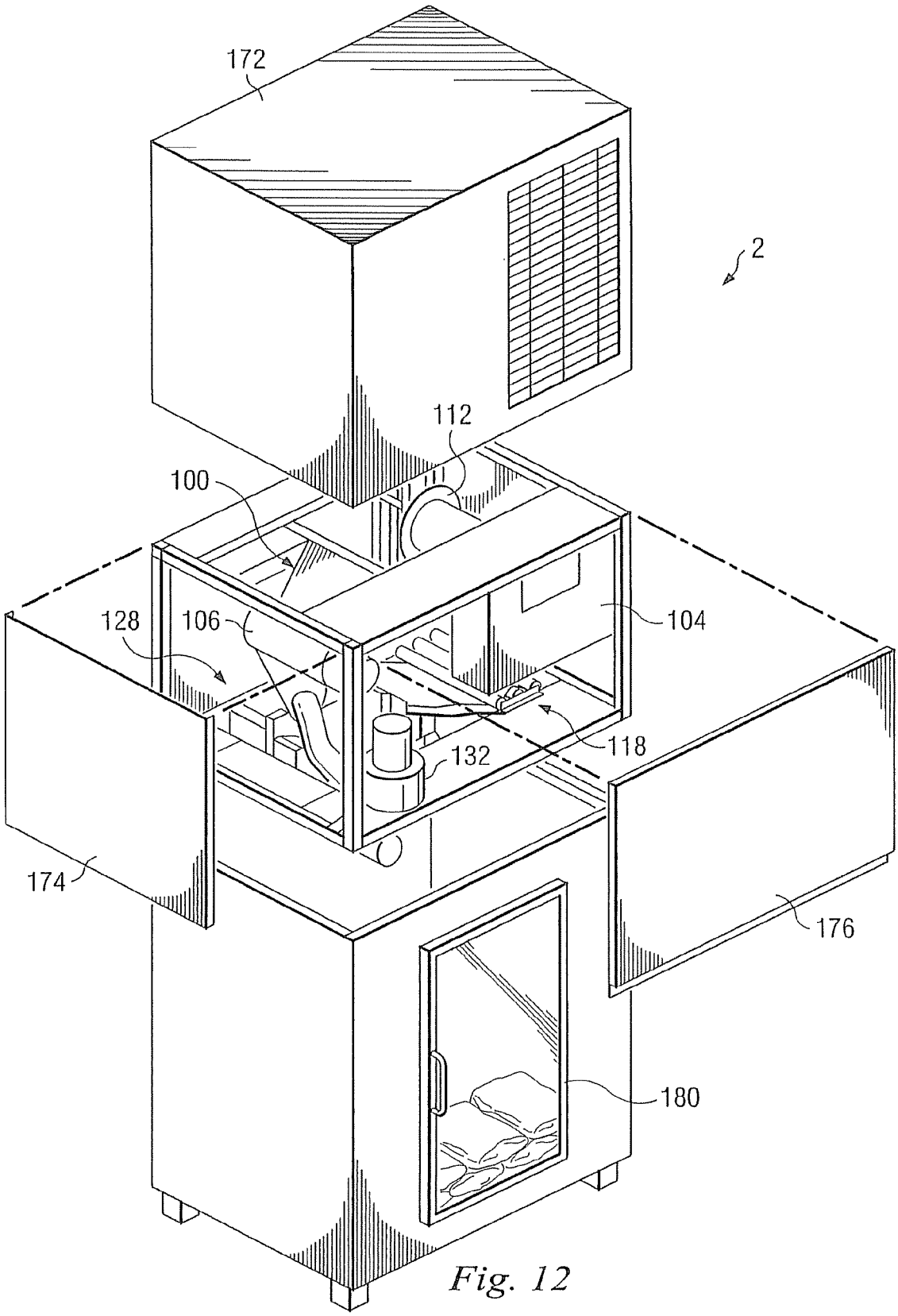
FIG. 12 is a perspective view of the embodiment of FIG. 4.

FIG. 12 shows a perspective view of the apparatus of FIG. 4. An ice maker for making ice is shown positioned above the hopper. FIG. 12 also shows the panels being removed so that the bag roll, idle rollers, and drawer is shown. The previously described control is also shown. FIG. 12 also shows the heat seal bar and bag cutter and blower fan. Once the ice is bagged, sealed and separated as previously described, the bag will be delivered into the freezer where a consumer can simply open the door and retrieve the desired number of bags of ice. It is possible to have a sensor mounted in the door and operatively connected to the control to determine if the door is open or closed. The apparatus can be conveniently placed within stores, restaurants, gas stations, etc. and be autonomously monitored and controlled, as previously set out.

The foregoing has been illustrative of the features and principles of the present invention. Changes and modifications in the specifically described embodiments can be carried out without departing from the scope of the invention which is intended to be limited only by the scope of the appended claims and equivalents thereof.

What is claimed is:

1. An apparatus comprising:

a hopper in which ice is adapted to be disposed;

a drawer movable relative to the hopper, the drawer comprising:

a first position; and a second position in which the ice is prevented from entering the drawer from the hopper;

a door movable relative to each of the hopper and the drawer, the door comprising:

a first position in which the ice is permitted to enter the drawer from the hopper when the drawer is in its first position; and a second position in which the ice is prevented from entering the drawer from the hopper when the drawer is in its first position;

a first actuator operably coupled to the drawer and adapted to move the drawer relative to each of the hopper and the door;

a second actuator operably coupled to the door and adapted to move the door relative to each of the hopper and the drawer;

a sensor coupled to the hopper and adapted to detect an amount of ice in the hopper;

a control unit operably coupled to the first actuator, the second actuator and the sensor an ice maker from which the hopper is adapted to receive the ice;

a bagging mechanism comprising a bag into which the drawer is adapted to deliver the ice; and a freezer adapted to store the bag after the ice has been delivered into the bag by the drawer;

wherein, when the drawer is in its first position and the door is in its second position, the door is disposed between at least a portion of the drawer and at least a portion of the hopper;

wherein the sensor sends a first signal to the control unit in response to the detection of the amount of ice in the hopper;

wherein the control unit sends a second signal to the second actuator in response to the receipt of the first signal by the control unit; and wherein the second actuator places the door in its second position in response to the receipt of the second signal by the second actuator.

2. An apparatus comprising:

a hopper in which ice is adapted to be disposed;

a drawer movable relative to the hopper, the drawer comprising:

a first position; and a second position in which the ice is prevented from entering the drawer from the hopper;

and a door movable relative to each of the hopper and the drawer, the door comprising:

a first position in which the ice is permitted to enter the drawer from the hopper when the drawer is in its first position; and a second position in which the ice is prevented from entering the drawer from the hopper when the drawer is in its first position.

3. The apparatus of claim 2 wherein, when the drawer is in its first position and the door is in its second position, the door is disposed between at least a portion of the drawer and at least a portion of the hopper; and wherein the apparatus further comprises:

an ice maker from which the hopper is adapted to receive the ice;

a bagging mechanism comprising a bag into which the drawer is adapted to deliver the ice; and a freezer adapted to store the bag after the ice has been delivered into the bag by the drawer.

4. The apparatus of claim 3 further comprising at least one of the following:

a first actuator operably coupled to the drawer and adapted to move the drawer relative to each of the hopper and the door; and a second actuator operably coupled to the door and adapted to move the door relative to each of the hopper and the drawer.

5. The apparatus of claim 4 comprising the first and second actuators;

wherein the apparatus further comprises:

a sensor coupled to the hopper and adapted to detect an amount of ice in the hopper;

a control unit operably coupled to the first actuator, the second actuator and the sensor;

wherein the sensor sends a first signal to the control unit in response to the detection of the amount of ice in the hopper;

wherein the control unit sends a second signal to the second actuator in response to the receipt of the first signal by the control unit; and wherein the second actuator places the door in its second position in response to the receipt of the second signal by the second actuator.

6. The apparatus of claim 2 wherein, when the drawer is in its first position and the door is in its second position, the door is disposed between at least a portion of the drawer and at least a portion of the hopper.

7. The apparatus of claim 2 further comprising:

a sensor coupled to the hopper and adapted to detect an amount of ice in the hopper;

wherein the door is placed in its second position in response to the detection of the amount of ice by the sensor.

8. The apparatus of claim 2 further comprising:

an ice maker from which the hopper is adapted to receive the ice;

a bagging mechanism comprising a bag into which the drawer is adapted to deliver the ice; and a freezer adapted to store the bag after the ice has been delivered into the bag by the drawer.

9. The apparatus of claim 2 further comprising:

a control unit operably coupled to the drawer and the door.

10. The apparatus of claim 9 wherein the control unit is in communication with a remotely-located server.

* * * * *